US006866620B2

(12) United States Patent
Friedman

(10) Patent No.: US 6,866,620 B2
(45) Date of Patent: Mar. 15, 2005

(54) VENTED BREATHABLE BAG FOR PERISHABLE PRODUCTS

(76) Inventor: Hershey Friedman, 1810 Lajoie Ave., Montreal, Quebec (CA), H2V 1S3

( * ) Notice: Subject to any disclaimer, the term of this patent is extended or adjusted under 35 U.S.C. 154(b) by 0 days.

(21) Appl. No.: 10/269,746

(22) Filed: Oct. 11, 2002

(65) Prior Publication Data

US 2004/0072665 A1 Apr. 15, 2004

(51) Int. Cl.[7] ..... B31B 1/60
(52) U.S. Cl. ..... 493/210; 493/223
(58) Field of Search ..... 383/9, 117; 493/210, 493/222, 223, 227, 194, 199, 189, 925

(56) References Cited

U.S. PATENT DOCUMENTS 3,554,368 A * 1/1971 Nagel ..... 206/471
3,850,084 A * 11/1974 Fowler et al. ..... 493/199
4,292,033 A * 9/1981 Wolske ..... 493/221
6,015,373 A * 1/2000 Henderson et al. ..... 493/196
6,024,489 A 2/2000 Fox et al.
6,030,120 A 2/2000 Fox et al.
6,080,093 A * 6/2000 Henderson et al. ..... 493/187
6,093,138 A * 7/2000 Sorenson et al. ..... 493/136
6,190,044 B1 2/2001 Fox et al.
6,234,944 B1 * 5/2001 Anderson et al. ..... 493/210
6,425,847 B1 * 7/2002 Broenstrup ..... 493/231
6,506,429 B1 * 1/2003 Recchia, Jr. ..... 426/106
6,574,940 B2 * 6/2003 Dauder Guardiola ..... 53/134.1

* cited by examiner

*Primary Examiner*—Eugene Kim
(74) *Attorney, Agent, or Firm*—Ogilvy Renault; Kevin P. Murphy

(57) ABSTRACT

A process for making successive product bags on an automated production line, comprises the steps of: a) providing a mesh sheet and first and second plastic sheets on rolls, unwinding the mesh sheet and the first and second plastic sheets from the rolls, b) while the sheets are advanced through the production line, folding one longitudinal edge portion of the second plastic sheet over the mesh sheet, c) sealing the folded portion of the second plastic sheet to one longitudinal side of the mesh sheet and the first plastic sheet to an opposed longitudinal side of the mesh sheet to form a master web, and d) sealing and cutting the master web along longitudinally spaced-apart lines transverse to a direction of travel of the sheets to thereby produce a succession of individual bags having one panel at least partly made of a mesh material.

12 Claims, 3 Drawing Sheets

VENTED BREATHABLE BAG FOR PERISHABLE PRODUCTS

BACKGROUND OF THE INVENTION

1. Field of the Invention

The present invention relates to product bags and, more particularly, to the manufacture of porous bags suited for packaging perishable products.

2. Description of the Prior Art

Mesh bags are useful for perishable food products, such as fruits and vegetables that need a relatively high degree of open ventilation to preserve their shelf life. However, when wicket holes are defined in such mesh bags for automatic procedure bag filling purposes, problems have been found to occur. Accordingly, it has been proposed to provide bags having one wall which is primarily made of a mesh material and a second wall made of a plastic sheet in which wicket holes are defined.

Although such composite bags are generally known, it has been found that there is a need to find a more efficient way of producing these types of composite wicket bags. It has also been found that there is a need for new breathable bag having enhanced strength characteristics.

SUMMARY OF THE INVENTION

It is therefore an aim of the present invention to provide a new manufacturing process by which perishable product bags can be made quickly and economically.

It is also an aim of the present invention to provide a new breathable bag which is adapted to more closely conform to the different shapes of the products inserted in the bag.

It is a further aim of the present invention to provide a new breathable bag having enhanced strength characteristics.

Therefore, in accordance with the present invention, there is provided a process for making successive product bags on an automated production line. The process comprises the steps of: providing a mesh sheet and first and second plastic sheets on rolls, unwinding the mesh sheet and the first and second plastic sheets from the rolls, while the sheets are advanced through the production line, folding one edge portion of the second plastic sheet over the mesh sheet, sealing said one edge portion of said second plastic sheet to one longitudinal side of said mesh sheet and said first plastic sheet to an opposed longitudinal side of said mesh sheet to form a master web, sealing and cutting said master web along longitudinally spaced-apart lines transverse to a direction of travel of said sheets to thereby produce a succession of individual bags having one panel at least partly made of a mesh material.

In accordance with a further general aspect of the present invention, there is provided a method of making breathable bags, comprising the steps of: joining a wide web and a narrow web of solid film material to opposed longitudinal sides of a web of mesh material with said wide web being folded in opposed facing relationship with the web of mesh material, thereby forming a master web, sealing and cutting the master web transversally across its width at selected longitudinally spaced-apart positions to form a plurality of individual bags.

In accordance with a still further general aspect of the present invention, there is provided a method for making bags on an automated process line from rolls of plastic material, comprising the steps of: providing a mesh sheet and first and second plastic sheets on rolls, continuously unwinding the mesh sheet and the first and second plastic sheets, folding one longitudinal edge portion of said second plastic sheet over a first longitudinal side of said mesh sheet, sealing the longitudinal edge portion of said second plastic sheet to said first longitudinal side of said mesh sheet and said first plastic sheet to a second opposed longitudinal side of said mesh sheet to form a master web, sealing and cutting said master web along longitudinally spaced-apart lines transverse to a direction of travel of said sheets to thereby produce a succession of individual bags.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
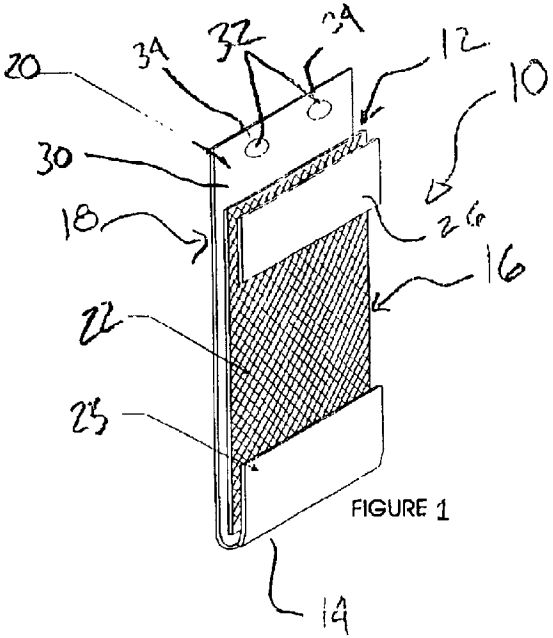
FIG. 1 is an exploded perspective view of a perishable product bag in accordance with a preferred embodiment of the present invention.

FIG. 1 illustrates a vented breathable bag 10 suited for packaging perishable products, such as fruits and vegetables. As will be seen hereinafter, the bag 10 is preferably made of three separate layers of 100% recyclable linear low density polyethylene film, two of which are solid layer substrates and one which is extruded as a mesh layer. The three separate layers are preferably double or triple impulse hot wire sealed in web direction to produce one master web which is then double cross sealed and hot knife cut in the middle of the two cross seals at longitudinally spaced-apart locations along the master web to produce a plurality of bags 10.

Figure 3:
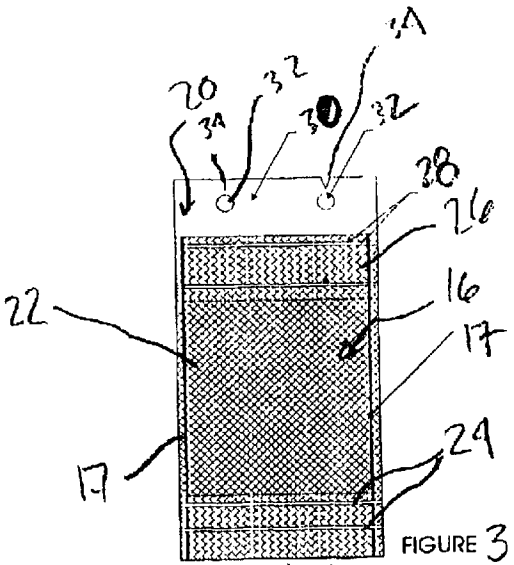
FIG. 3 is a front view of the bag shown in FIG. 1.
Figure 4:
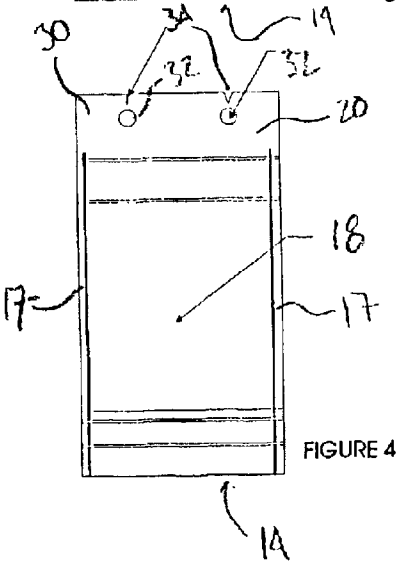
FIG. 4 is a rear view of the bag shown in FIG. 1.

More particularly, the bag 10 comprises an open top 12, a closed bottom 14, a front panel 16 and a rear panel 18. The front an rear panels 16 and 18 are sealed to each other along corresponding side edges thereof as indicated at 17 (see FIGS. 3 and 4). According to a preferred embodiment of the present invention, the rear panel 18 consists of a solid sheet 20 of synthetic resin film, such as low density polyethylene, linear low density polyethylene, high density polyethylene or other stretchable plastic materials. The lower end 23 of the sheet 20 is folded upwardly against an outer surface of a thermoplastic mesh sheet 22 forming the major portion of the front panel 16 of the bag 10. The thermoplastic mesh sheet 22 preferably consists of a 100% linear low density polyethylene film extruded as a mesh layer. As shown in FIG. 3, the sheet 20 is joined to the mesh sheet 22 by two or three parallel welding or seal lines 24 extending across the width of the bag 10. The seal lines 24 are preferably done by double or triple impulse hot wire sealing technique. The double or triple impulse hot wire linear seals advantageously provide enhanced strength characteristics by increasing the seal contact area between the solid and mesh sheets 20 and 22 without the normal seal distortions.

In this way the closed bottom 14 of the bag 10 is formed by the folded lower end portion 23 of the sheet 20 and the seal lines 24 are spaced upwardly from the closed bottom end 14. This construction provides a sturdy bag which is more resistant to impact and weight of the products as they enter the bag during filling operations. The fact that the mesh sheet 22 extends beyond the seal lines 24 down to the closed bottom 14 of the bag 10 also contributes to increase the strength of the bag 10.

As shown in FIG. 1, the front panel 16 is completed by a reinforcing strip 26 joined to the upper end of the mesh sheet 22 by two or three seal lines 28 (FIG. 3) extending across the front panel 16 of the bag 10. The seal lines 28 are preferably done by double or triple impulse hot wire sealing technique. The reinforcing strip 26 is preferably provided in the form of a relatively narrow thermoplastic film, such as low density polyethylene, linear low density polyethylene, high density polyethylene or other stretchable plastic materials. The reinforcing strip 26 provides for extra strength and ability for easy opening of the bag during automatic bag filling operations. Indeed, the reinforcing strip 26 can advantageously be used for the automatic bag filling machinery to enable opening of the mouth of the bag 10 during filling.

Figure 2:
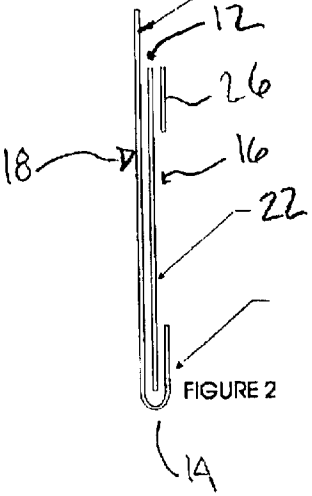
FIG. 2 is an exploded side view of the bag shown in FIG. 1.

As shown in FIGS. 1, 2 and 3, the rear panel 18 is longer in length than the front panel 16, thereby providing a lip 30 or raised back panel in which laterally spaced-apart wicket holes 32 are defined for receiving the wicket prongs of an automatic bag filling machine. The lip 30 forms an integral part of the sheet 20. Cuts or slits 34 are defined in the lip 30 above the wicket holes 32 to provide for the bag 10 to easily break away from the machinery during bag filling operation.

The fact that the bag 10 is made of stretchable materials advantageously allows the bag 10 to conform to the different shapes of the products inserted therein. This contributes to disperse the stress placed on the bag 10 by the product. This also enables superior stacking of the packaged product during display and results in longer life span of the product by enabling more of the product to be in contact with the lower layer stacked and therefore minimizes bruising.

The mesh sheet 22 offers maximum air flow through and around the packed products to ensure that the products in the bag 10 remain fresh longer.

Figure 5:
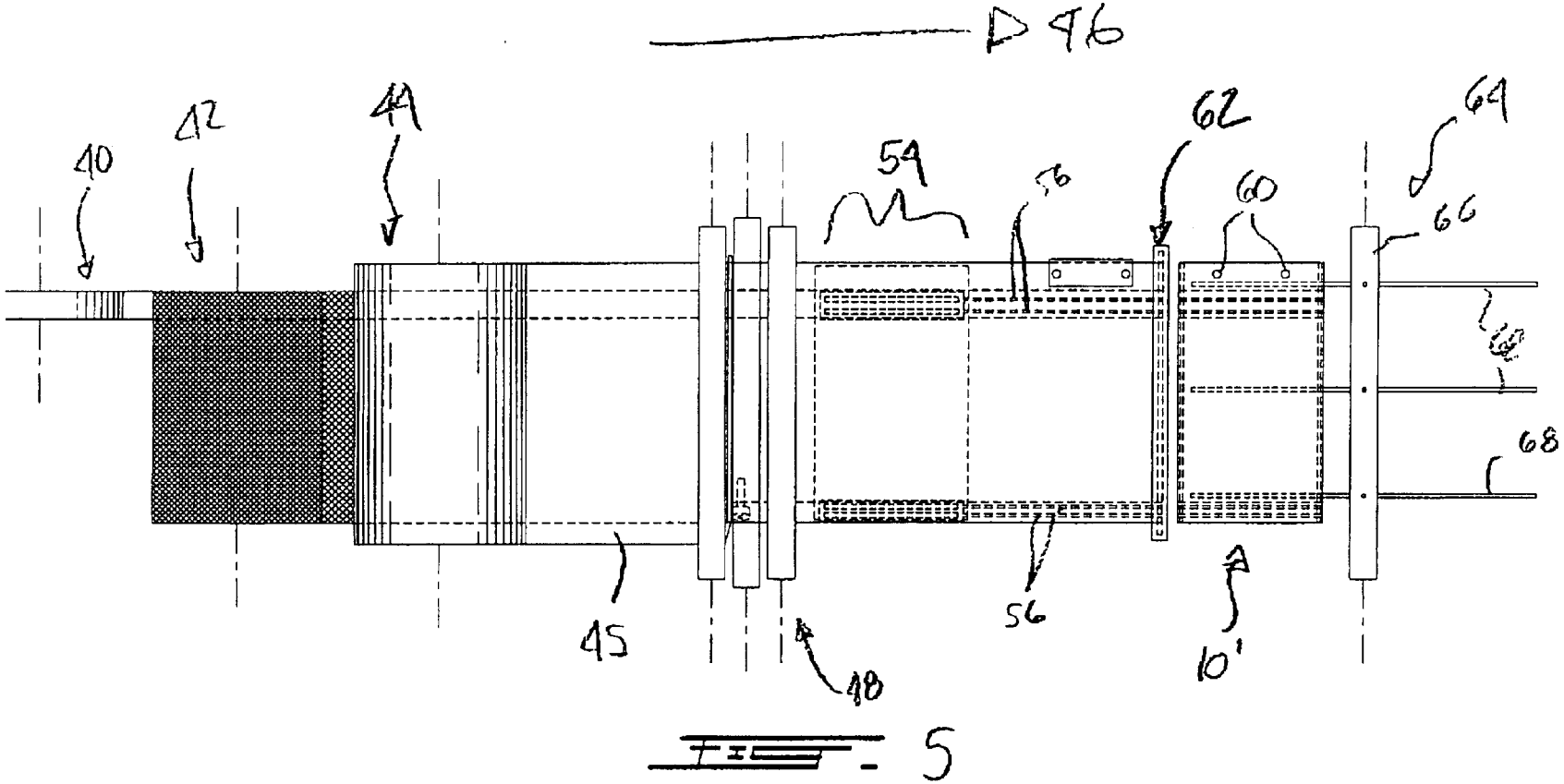
FIG. 5 is a top plan view of an automated production lines for making perishable product bags from rolls of sheet material.
Figure 6:
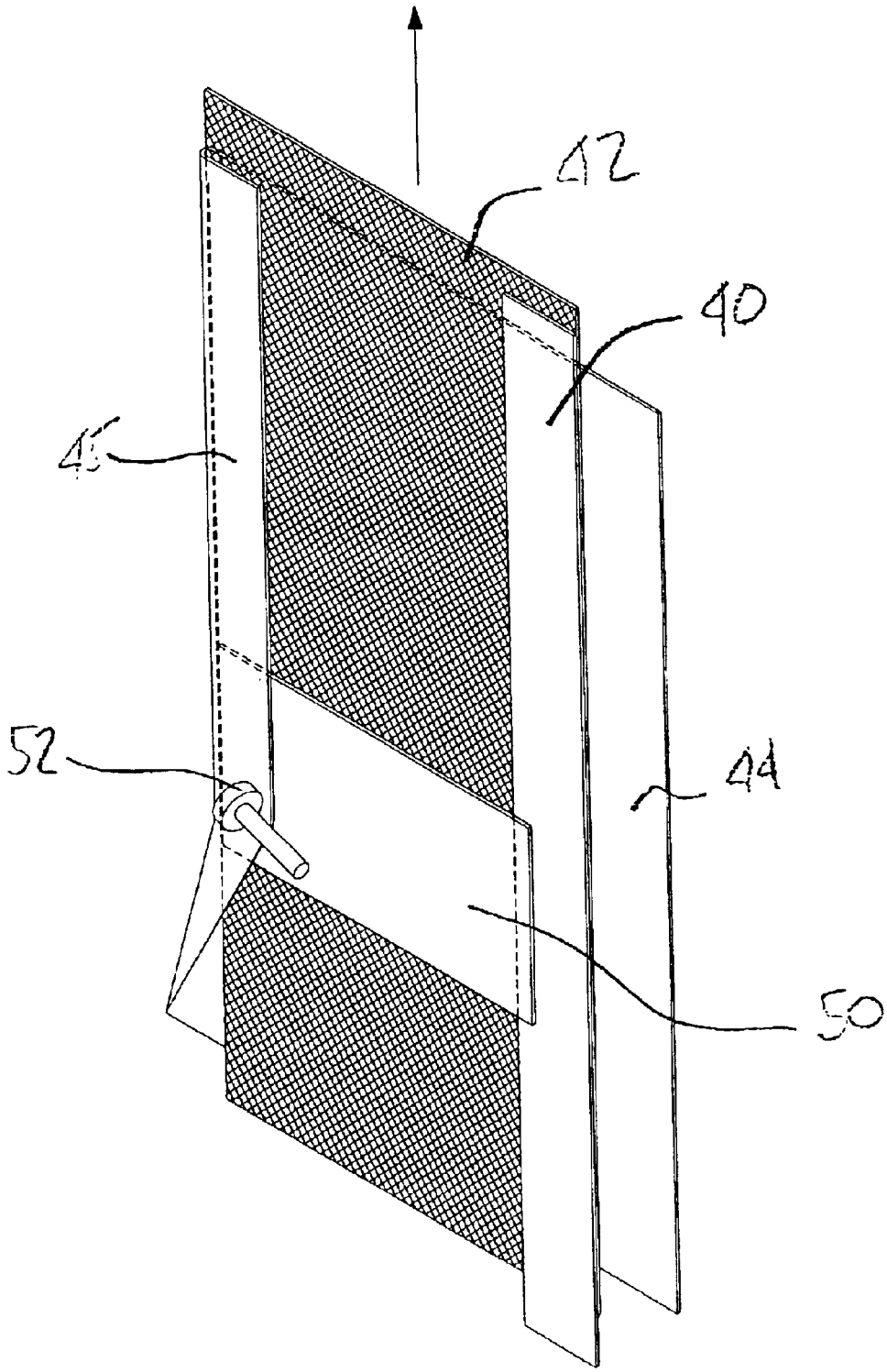
FIG. 6 is a schematic perspective view of a folding station forming part of the production line shown in FIG. 5.

As shown in FIG. 5, breathable bags like bag 10 are manufactured from three separate rolls of material preferably consisting of a roll 40 of narrow polyethylene web, a roll 44 of wide polyethylene web and a roll 42 of polyethylene mesh web. Rolls 40, 42 and 44 are respectively used for making the reinforcing strip 26, the mesh sheet 22 and the sheet 20 of the bag 10. The sheeting materials or webs are continuously unwound from the rolls 40, 42 and 44 and advanced through a production line as indicated by arrow 46. While the three layers of film or webs are guided through the production line with the mesh material 42 extending between the narrow and wide polyethylene webs 40 and 44, one longitudinal side edge portion 45 of the wide web 44 opposite the narrow web 40 is folded over the mesh web 42 to form the fold portion 23 of the bag 10. The fold is formed at a folding station 48. As shown in greater details in FIG. 6, the fold is formed on a stationary lip forming plate 50 by an idle lip fold wheel 52 angularly oriented relative to a direction of travel of the wide polyethylene web 44 so as to exert a traction force on the wide web 44 as the same engages the wheel 52. Once the wide web 44 has been folded as described above, the three webs 40, 42 and 44 are passed through a sealer 54 where the narrow web 40 and the folded portion of the wide web 44 are double or triple impulse hot wire sealed in web direction to opposed longitudinal sides of the mesh web 42, thereby forming a composite master web. The double or triple seal lines 56 formed in the sealer 54 correspond to the transverse seal lines 24 and 28 of the bag 10. A pair of pneumatically or hydraulically actuated perforation pins 58 may also be provided at the sealer 54 or downstream thereof to punch a pair of wicket holes 60 (corresponding to holes 32 in bag 10) at regular longitudinally spaced-apart intervals through the wide web 44 at a location adjacent to the narrow web 40. The master web formed by the tree assembled webs 40, 42 and 44 is then passed to a double cross sealer and cutter 62 where the master web is double cross sealed and hot knife cut in the middle of the two cross seals to produce a bag 10'. The bag 10 is then pick up by a bag handler 64 comprising a rotating drum 66 from which radiates a plurality of circumferentially spaced-apart sets of picking forks 68. In operation, the bag handler 64 receives the individual bags and rotates to stack successive bags on wickets (not shown) to be packed on cartons and delivered to the end user.

Manufacturing such bags on wicketer type machines advantageously provides a method of bundling for automated packaging of carousel style machinery or on conventional machinery for manually packing the bags.

What is claimed is:

1. A process far making successive product bags on an automated production line, comprising the stops of: a) providing a mesh sheet and first and second plastic sheets on rolls, unwinding the mesh sheet and the first and second plastic sheets from the rolls, b) while the sheets are advanced through the production line, folding one longitudinal edge portion of the second plastic sheet over the mesh sheet such that the second plastic sheet and the mesh sheet form opposed facing sides of a bag having a seamless bottom formed by said longitudinal edge portion of said second plastic sheet, c) sealing said one edge portion of said second plastic sheet to one longitudinal side of said mesh sheet and said first plastic sheet to an opposed longitudinal side of said mesh sheet to form a master web, and d) sealing and outting said master web along longitudinally spaced-apart lines transverse to a direction of travel of said sheets to thereby produce a succession of individual bags having one panel at least partly made of a mesh material reinforced at a mouth of the bags by a reinforcement strip formed by said first plastic sheet.

2. A process am defined in claim 1, wherein step b) is effected by passing the second plastic sheet over a stationary lip fanning plate and causing the second plastic sheet to engage an idle wheel located on a side of the stationary lip forming plate opposite to said second plastic sheet and angularly oriented relative to a direction of travel of the second plastic sheet so as to exert thereon a traction causing the longitudinal edge portion to be folded over against said opposed side of said stationary lip forming plate.

3. A process as defined in claim 1, wherein step c) is effected by impulse hot wire sealing the first and second plastic sheets to the mesh sheet.

4. A process as defined in claim 3, wherein step c) includes the step of forming at least two linear seal lines along each longitudinal aide of the mesh sheet.

5. A process as defined in claim 1, wherein step d) is effected by double cross sealing so as to form two cross seals, and by hot knife cutting between the two cross seals.

6. A process as defined in claim 1, further comprising the steps of punching a pair of wicket holes at regular interval in said second sheet of plastic material.

7. A method for making bags on an automated process line from rolls of plastic material, comprising the steps of: a)

providing a mesh sheet and first and second plastic sheets on rolls, b) continuously unwinding the mesh sheet and the first and second plastic sheets, c) folding one longitudinal edge portion of said second plastic sheet over a first longitudinal side of said mesh sheet, d) sealing the longitudinal edge portion of said second plastic sheet to said first longitudinal side of maid mesh sheet and said first plastic sheet to a second opposed longitudinal side of said mesh sheet to form a master web, and e) sealing and cutting said master web along longitudinally spaced-apart lines transverse to a direction of travel of said sheets to thereby produce a succession of individual bags having a seamless closed bottom end defined by the folded longitudinal edge portion of the second plastic sheet and a mouth provided with a reinforcing strip formed by said first plastic sheet.

8. A method as defined in claim 7, wherein step c) is effected by passing the second plastic sheet over a stationary lip forming plate and causing the second plastic sheet to engage an idle wheel located on a side of the stationary lip forming plate opposite to said second plastic sheet and angularly oriented relative to a direction of travel of the second plastic sheet so as to exert thereon a traction causing the longitudinal edge portion to be folded over against said opposed side of said stationary lip forming plate.

9. A method as defined in claim 7, wherein step d) is effected by impulse hot wire sealing the first and second plastic sheets to the mesh sheet.

10. A method as defined in claim 9, wherein step d) includes the step of forming at least two linear seal lines along each longitudinal side of the mesh sheet.

11. A method as defined in claim 7, wherein step e) is effected by double cross sealing so as to form two cross seals, and by hot knife cutting between the two cross seals.

12. A method as defined in claim 7, further comprising the steps of punching a pair of wicket holes at regular interval in said second sheet of plastic material.

* * * * *